US011402070B2

(12) United States Patent
Reid et al.

(10) Patent No.: US 11,402,070 B2
(45) Date of Patent: Aug. 2, 2022

(54) TRANSPORTING BITUMEN FROTH HAVING COARSE SOLIDS THROUGH A PIPELINE

(71) Applicant: SYNCRUDE CANADA LTD. in trust for the owners of, Calgary (CA)

(72) Inventors: Kevin Reid, Edmonton (CA); Gary Anthieren, Spruce Grove (CA); Sean Sanders, Edmonton (CA); Jason Schaan, Okotoks (CA)

(73) Assignee: SYNCRUDE CANADA LTD. IN TRUST FOR THE OWNERS OF, Calgary (CA)

( * ) Notice: Subject to any disclaimer, the term of this patent is extended or adjusted under 35 U.S.C. 154(b) by 198 days.

(21) Appl. No.: 16/947,939

(22) Filed: Aug. 25, 2020

(65) Prior Publication Data

US 2021/0062976 A1 Mar. 4, 2021

Related U.S. Application Data

(60) Provisional application No. 62/891,816, filed on Aug. 26, 2019.

(51) Int. Cl.
*F17D 1/00* (2006.01)
*F17D 1/16* (2006.01)
*F17D 1/08* (2006.01)

(52) U.S. Cl.
CPC ..... *F17D 1/16* (2013.01); *F17D 1/088* (2013.01)

(58) Field of Classification Search
CPC ..... F17D 1/088
See application file for complete search history.

(56) References Cited

U.S. PATENT DOCUMENTS 3,998,702 A * 12/1976 Opoku ..... B01D 19/001 261/123
4,167,292 A * 9/1979 Eller ..... C10G 1/045 299/17
4,305,688 A * 12/1981 Savins ..... F17D 1/088 406/197
4,863,317 A * 9/1989 Boyle ..... B65G 53/30 406/197
5,840,102 A * 11/1998 McCracken ..... B65F 3/0209 55/342
5,988,198 A * 11/1999 Neiman ..... F17D 1/16 507/90
6,391,190 B1 * 5/2002 Spence ..... C10G 1/047 208/341
6,800,116 B2 * 10/2004 Stevens ..... B01D 21/009 96/182

(Continued)

OTHER PUBLICATIONS

Gillies, R.G., Hill, K.B., McKibben, M.J., Shook, C.A., "Solids Transport by Laminar Newtonian Flows", Powder Technology, p. 269-277, vol. 104, 1999.

(Continued)

*Primary Examiner* — Joseph A Dillon, Jr.
(74) *Attorney, Agent, or Firm* — Bennett Jones LLP

(57) ABSTRACT

A method for transporting a bitumen froth having coarse solids having a particle size>180 μm through a pipeline is provided comprising injecting into the pipeline a bitumen froth slug having a lower temperature or a lower water content or both that the bitumen froth.

8 Claims, 9 Drawing Sheets

(56) References Cited

U.S. PATENT DOCUMENTS

| | | | | |
|---|---|---|---|---|
| 7,610,818 | B2 * | 11/2009 | Sanders | G01F 1/44 73/861.63 |
| 8,074,715 | B2 * | 12/2011 | Rispler | E21B 33/1208 166/280.1 |
| 8,685,210 | B2 * | 4/2014 | Gaston | C10G 1/02 196/14.52 |
| 9,089,797 | B2 * | 7/2015 | Sutton | B03D 1/1493 |
| 9,694,993 | B2 * | 7/2017 | Revega | F17D 3/01 |
| 9,791,170 | B2 * | 10/2017 | Van Der Merwe | F24H 9/00 |
| 10,041,005 | B2 * | 8/2018 | Van Der Merwe | C10G 1/04 |
| 10,190,062 | B2 * | 1/2019 | Gupta | C10C 3/14 |
| 10,427,074 | B2 * | 10/2019 | Song | C10G 1/045 |
| 10,544,370 | B2 * | 1/2020 | Mazyar | C10G 1/045 |
| 10,619,104 | B2 * | 4/2020 | Palmer | C10C 3/08 |
| 10,793,786 | B2 * | 10/2020 | Gupta | C10G 55/04 |
| 10,907,103 | B2 * | 2/2021 | Reid | C10G 1/008 |
| 11,015,125 | B2 * | 5/2021 | Palmer | C10C 3/08 |
| 11,098,254 | B2 * | 8/2021 | Knapper | C10G 33/04 |
| 11,268,033 | B2 * | 3/2022 | Long | C10G 1/045 |
| 2009/0214302 | A1 * | 8/2009 | Ilgner | F17D 3/18 406/14 |
| 2009/0321326 | A1 * | 12/2009 | Spence | B03B 9/02 208/391 |
| 2011/0114539 | A1 * | 5/2011 | Stokes | B03D 1/02 196/14.52 |
| 2014/0042055 | A1 * | 2/2014 | Brownie | C10G 21/16 208/45 |
| 2015/0210915 | A1 * | 7/2015 | Abulnaga | C09K 8/52 422/162 |
| 2017/0081592 | A1 * | 3/2017 | Spence | C10G 1/045 |
| 2018/0044595 | A1 * | 2/2018 | Mazyar | C10G 1/047 |
| 2019/0153327 | A1 * | 5/2019 | Hoskins | G01N 15/02 |
| 2019/0309227 | A1 * | 10/2019 | Reid | C10G 1/008 |
| 2020/0102505 | A1 * | 4/2020 | Long | C10G 1/045 |
| 2021/0155845 | A1 * | 5/2021 | Ren | C09K 8/594 |
| 2021/0348057 | A1 * | 11/2021 | Palmer | C10C 3/007 |

OTHER PUBLICATIONS

McKibben, M., Gillies, R., "Water Assisted Pipeline Transport of Bitumen/Heavy Oils and Co-Produced Sand", Petroleum Technology Research Centre, PTRC No. 001-00086-SRC Year 3 Report, SRC Publication No. 11716-1C09, Mar. 2009.

Joseph, D. D. Bai, R., Mata, C., Sury, K., Grant, C., "Self-Lubricated Transport of Bitumen Froth", J. Fluid Mech., p. 1-21, Dec. 1998.

* cited by examiner

TRANSPORTING BITUMEN FROTH HAVING COARSE SOLIDS THROUGH A PIPELINE

FIELD OF THE INVENTION

The present invention relates to a method for transporting a bitumen froth having coarse solids having a particle size >180 μm through a froth pipeline. In particular, the method comprises injecting into the pipeline a limited volume of a low temperature and/or low water content bitumen froth to prevent the formation of or to remove a stationary or sliding bed of coarse solids.

BACKGROUND OF THE INVENTION

Oil sand ore is a mixture of bitumen, minerals including clays and sands, and water. Recovering bitumen from the ore begins with excavating the ore, such as by using a shovel in an open pit mine. Trucks deliver the excavated ore to a hopper, which in turn feeds the ore to a crusher. The crushed ore is mixed with hot or warm water to form a slurry. A pipeline hydro-transports the slurry to an extraction facility where it is subjected to gravity separation in a primary separation vessel (PSV) to produce a bitumen froth process stream, a middlings stream, and a tailings stream. The bitumen froth is then transported, often through a froth pipeline, to a froth treatment plant, where the froth is further treated with light hydrocarbon solvent and subjected to mechanical separation processes to recover bitumen.

Recently, it has become apparent that in some mine areas, the ore body may contain ores having a high amount of coarse solids (solids having a particle size >180 μm). When these high coarse solids ores are processed in a water-based bitumen extraction process, one would expect the coarse solids to settle out, but surprisingly the bitumen froth produced may contain a high amount of coarse solids. In cases where the extraction facilities are far away from the froth treatment plant, a froth pipeline that runs tens of kilometers is used to transport the froth from extraction to froth treatment.

Froth pipelines are generally designed to transport a froth that normally has a high fines content and a low coarse solids content (where $d_{90}$ is less than 180 μm). However, if the froth contains considerably higher amount of coarse particles, it is difficult to transport the froth due to the settling of the coarse particles. Froth pipelines typically operate at low velocities relative to traditional slurry lines and this can lead to stationary/sliding beds forming in the pipeline when these large solids are introduced. If these beds grow too large, they can restrict the flow within the pipeline, which in turn leads to reduced production. A solution is required to remove these large solids from the froth line while maintaining the throughputs required for production.

SUMMARY OF THE INVENTION

In one aspect, the present invention provides a method for transporting a bitumen froth having a first water content, a first temperature and coarse solids having a particle size >180 μm through a pipeline, the method comprising the steps of:

injecting the bitumen froth into the pipeline; and injecting into the pipeline a volume of a bitumen froth slug having a second water content and a second temperature to prevent the formation of or to remove a stationary or sliding bed of coarse solids;

whereby either the second water content, the second temperature or both of the bitumen froth slug is lower than either the first water content, the first temperature or both of the bitumen froth.

In one embodiment, the second water content is between about 2 wt % and 10 wt % lower than the first water content. In one embodiment, the second temperature is between about 2° C. to about 10° C. lower than the first temperature.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF PREFERRED EMBODIMENT

Definitions. Any term or expression not expressly defined herein shall have its commonly accepted definition understood by a person skilled in the art. As used herein, the following terms have the following meanings.

As used herein, "oil sands ore" refers to a mixture of bitumen, minerals, and water prior to being subjected to a bitumen extraction process.

As used herein, "fines" refers to the component of the solids in an oil sands ore having a particle size less than 44 microns.

As used herein, "coarse solids" refers to the component of the solids in an oil sands ore having a particle size greater than 180 microns.

As used herein, a "water-based bitumen extraction process" comprises three main steps: oil sand slurry preparation, slurry conditioning and bitumen separation in primary separation vessels (PSVs) and is performed at a water-based bitumen extraction plant.

As used herein, "bitumen froth slug" refers to bitumen froth injected into a bitumen froth pipeline which has a reduced temperature and/or water content relative to the bitumen froth already in the pipeline.

Figure 1:
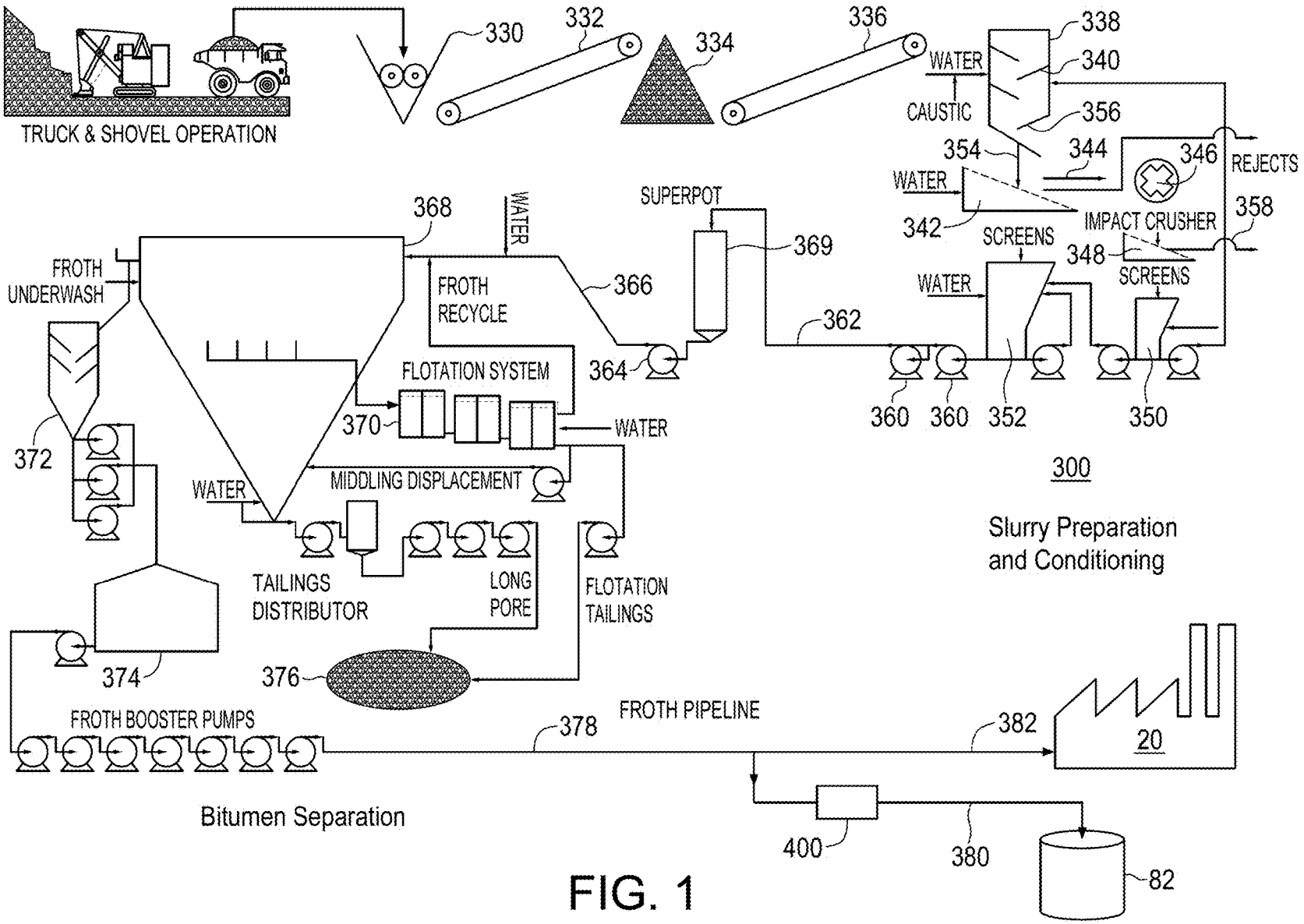
FIG. 1 is a schematic of a typical water-based bitumen extraction plant and process for producing bitumen froth.

FIG. 1 is a schematic of a typical water-based bitumen extraction plant and process. A water-based bitumen extraction plant generally comprises an oil sand slurry preparation plant, a slurry conditioning apparatus and a bitumen separation plant. In this particular embodiment, oil sand ore is surface mined using shovels and transported by trucks to be pre-crushed in a primary crusher 330, preferably a double roll crusher. Pre-crushed oil sand is then conveyed by conveyor 332 and stock piled until further use (surge pile 334). The pre-crushed oil sand is then conveyed by conveyor 336 to a mix box 338 where hot slurry water and caustic (e.g., sodium hydroxide) is added to form a slurry. Mix box 338 comprises a plurality of mixing shelves 340 to mix the oil sand with hot slurry water to produce oil sand slurry. Oil sand slurry 354 leaves the bottom outlet 356 of the mix box 338 as unscreened slurry 354 and is then screened using screen 342 where additional hot slurry water can be added. The screened slurry is then deposited in pump box 352.

Screened rejects 344 are fed to an impact crusher 346 and screened again through screen 348. Oversize rejects 358 are discarded but screened material enters pump box 350, where more water is added and then oil sand slurry is pumped into pump box 352. The oil sand slurry in pump box 352 is then pumped via pumps 360 through a hydrotransport pipeline 362 for conditioning to produce conditioned oil sand slurry.

If the mine site is very remote, i.e., it is too far away from an existing bitumen separation plant to make it economical to transport the conditioned oil sand slurry to the existing plant, a bitumen separation plant is also provided at or near the remote mine site. Conditioned oil sand slurry is transferred to slurry distributor 369 (superpot) and then pumped via pump 364 through a second section 366 of pipeline where cold flood water is added. Diluted slurry is then introduced into primary separation vessel (PSV) 368 and retained under quiescent conditions, to allow the solids to settle and the bitumen froth to float to the top. A froth underwash of hot water is added directly beneath the layer of bitumen froth to aid in heating the froth and improving froth quality.

Thus, a bitumen froth layer, a middlings layer and a solids layer are formed in the primary separation vessel 368. Middlings from primary separation vessel 368 are removed and undergo flotation in flotation cells 370 to produce secondary froth.

Secondary froth is recycled back to the primary separation vessel 368. Tailings, comprising the solids, water, etc. that collects at the bottom of the primary separation vessel 368 are removed and deposited into tailings pond 376 or sent to a composite tailings plant.

Bitumen froth, or primary froth, is removed from the top of the primary separation vessel 368 and then deaerated in froth deaerator 372. Once deaerated, the primary froth can be retained in froth tank 374. Depending upon the location of the bitumen extraction plant, the bitumen froth may need to be pumped through a froth pipeline to a froth treatment plant, which froth treatment plant may be tens of kilometers away. Froth treatment is a process by which water and fine solids are removed from the bitumen froth using hydrocarbon-based gravity and centrifugal separation, typically using either a naphtha-based hydrocarbon or a paraffinic solvent.

Bitumen froth can vary in bitumen content, water content and solids content. Bitumen content can vary from about 45 wt % to about 65 wt %; water content can vary from about 20 wt % to about 35 wt %; and solids content can vary from about 5 wt % to about 15 wt %. Thus, the bitumen froth is normally diluted with dilution water 375 prior to being pumped through froth pipeline 378 to the froth treatment plant. However, if the froth contains a considerable amount of coarse particles, it is difficult to transport the froth due to the settling of the coarse particles. The typical operating range for a froth line is not able to transport coarse solids greater than about 180 microns. If enough solids accumulate in the line, it can lead to severe production limitations due to increased overall pressure gradients. Thus, there is a need in the industry for a means for preventing the formation of a stationary or sliding bed of coarse solids and/or removing a bed of coarse solids from the line while still maintaining production rates.

It was discovered that the presence of coarse solids occurs primarily when processing an oil sand ore having high amounts of coarse solids. Studies show that there is a correlation/relationship between the particle size distributions (PSDs) of the solids in the ore and in the corresponding froth, indicating that the amount and types of solids in the froth are related to or determined by the solids in the ore.

Figure 2:
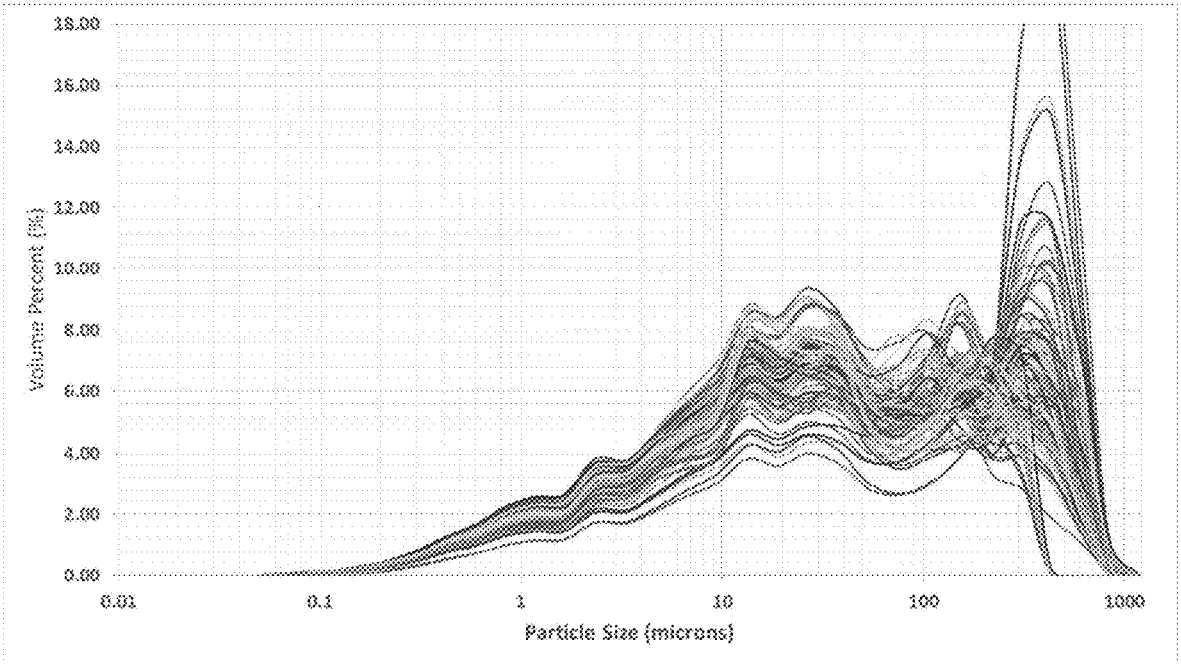
FIG. 2 shows the particle size (microns) distribution in a variety of bitumen froths produced from different ores.

FIG. 2 shows the particle size (microns) distribution in a variety of bitumen froths produced from different ores. It can be seen that, in some bitumen froths, there can be a high amount of solids present in the 180 to 600 micron range.

When dealing with a sand-water slurry (as opposed to a bitumen froth line), one viable way to reduce the formation of sand beds in a pipeline is to increase the density feeding the pipeline; higher density material can suspend larger particles. In the alternative, if pumping higher density material is not practical, one can run water at higher rates to move the solids in the sand-water slurry. However, in the present instance, when dealing with a bitumen froth pipeline, it is difficult to significantly increase the density in the froth line, as the density of the froth is not a controlled variable. Further, the design flow rates/velocities in the froth line are not high enough to move solids with water only flows. Since froth lines can be very long, bringing the entire line down to clean mechanically is a cost prohibitive option and another solution is required.

For bitumen froth lines, there are two known mechanisms of solids suspension, turbulent suspension and pressure dispersion. In both of these mechanisms, a higher pressure gradient improves solids transport. The pressure dispersion mechanism will suspend particles of any reasonable size (~500 microns) while the particle size that can be suspended by the turbulence mechanism varies with the specific values of water content, temperature and flow.

Any pumping/piping system has a set distance and installed pump head. Together, these two parameters determine the average pressure gradient that can occur within the pipeline; this is simply the maximum pump discharge pressure divided by the total pipeline length:

$$\frac{DP}{DL} = \frac{\text{Pump Discharge Pressure}}{\text{Pipeline Length}} \qquad \text{Equation 1}$$

For example, in a typical froth line operating in the present applicant's plant, the discharge pressure at one end of the pipeline is 5000 kPa and the discharge pressure at the other is ~0 kPa, giving a pressure gradient of ~120 Pa/m over the 42.5 km length of the pipeline. It is clear that this typical pressure gradient is significantly less than the 1500 Pa/m required for laminar transport of particles, indicating the normal mechanism of solids transport in the froth line is turbulent suspension. The maximum pressure gradient of 120 Pa/m was selected for this pipeline, as it is the maximum pressure gradient required to operate "bed free" through the required range of froth flows for typical froth compositions (i.e., wherein the maximum particle size is less than 180 microns). Bed free flow is expected with the typical maximum particle size in the froth being approximately 180 microns. This is shown in FIG. 3.

Figure 3:
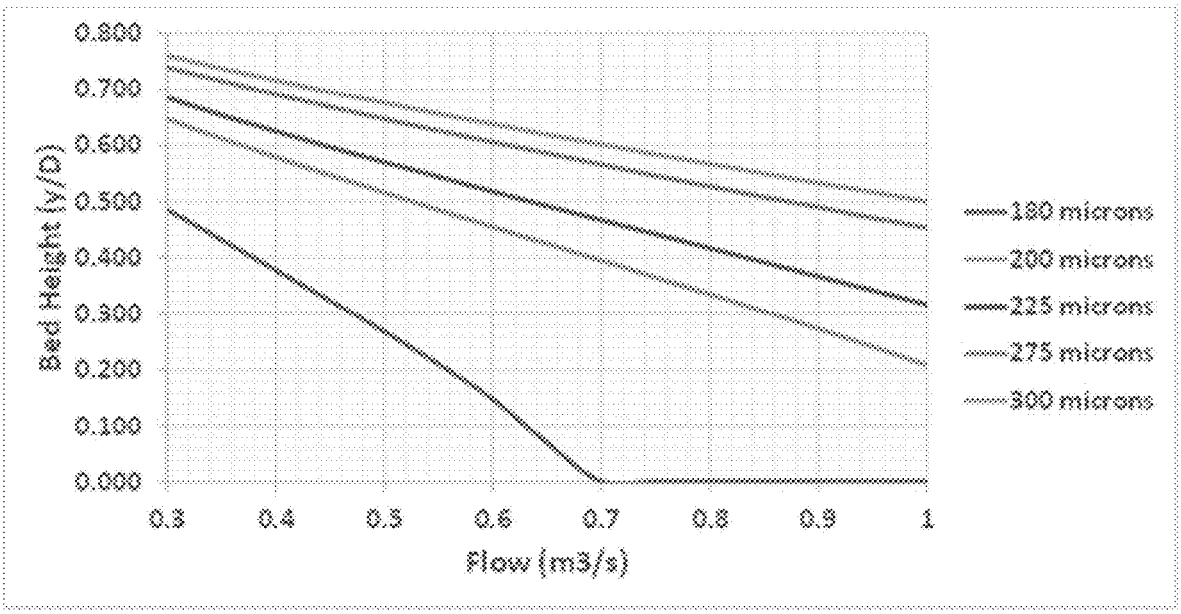
FIG. 3 shows the stationary bed height (y/D) for various particle sizes with a typical bitumen froth composition.

FIG. 3 plots the bed height (vertical position in a pipe determined by a densitometer), as a fraction of the pipe diameter (y/D), of a particle bed forming at the bottom of a pipeline at various flow rates ($m^3/s$) for a froth line composition (55° C./28% water) having increasingly larger solids present therein. As mentioned, a typical froth having a maximum particle size of 180 microns requires a minimum flow rate of 0.7 $m^3/s$ in order to avoid formation of a bed at the bottom of the pipe. However, as previously discussed, more and more of the ore bodies at the applicant's mine site contain ores having greater amounts of coarse solids (i.e., greater than 200 microns).

FIG. 3 clearly shows that, as the maximum particle size in the froth increases, at the same flow rate of 0.7 $m^3/s$, there is an increasingly larger bed being formed. In particular, at a particle size of 200 microns or greater, ever a flow rate of 1 $m^3/s$ cannot prevent the formation of a bed in the pipeline.

Figure 4:
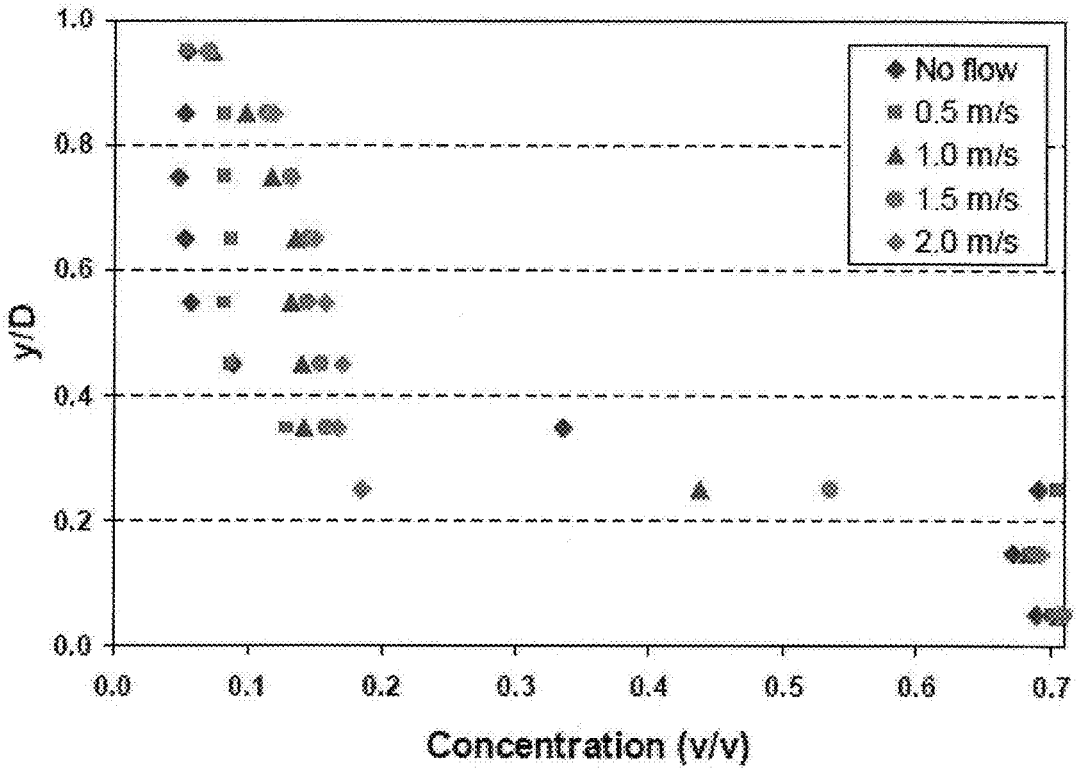
FIG. 4 shows the concentration profile data for a bitumen froth having 41% total water, 12% sand at 45° C. when pumped through a 260 mm pipeline.
Figure 5:
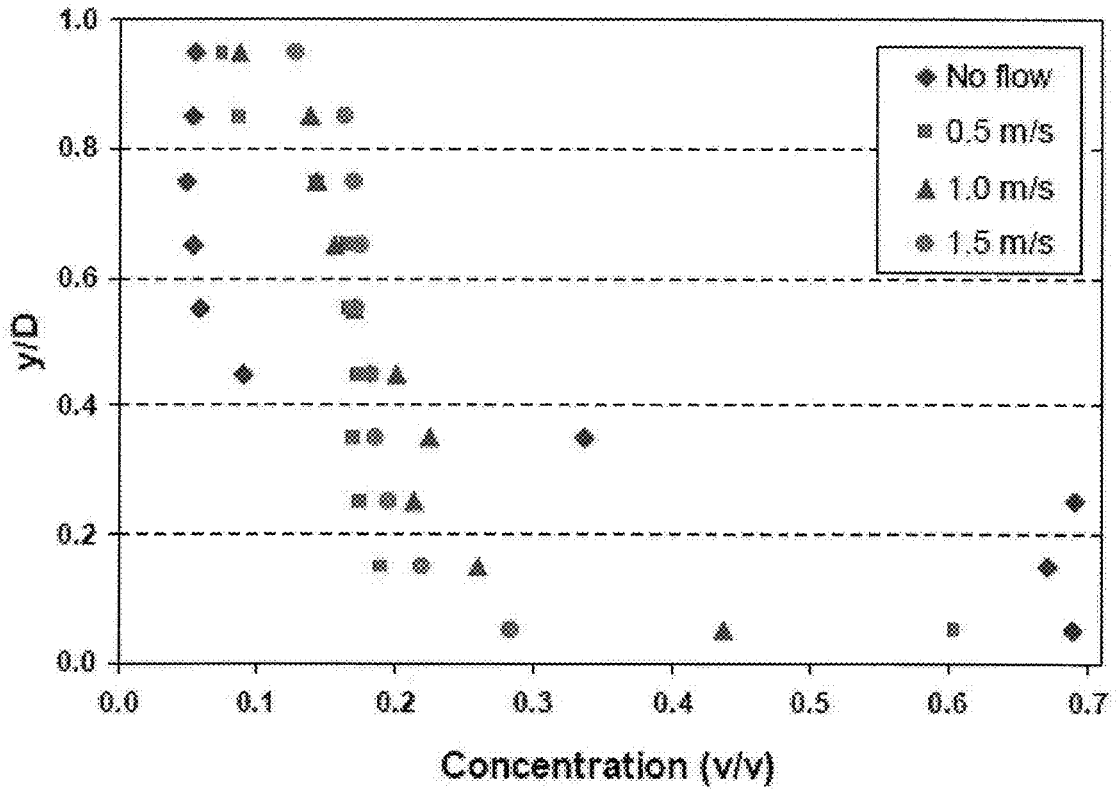
FIG. 5 shows the concentration profile data for a bitumen froth having 28% total water, 12% sand at 35° C. when pumped through a 260 mm pipeline.

As previously mentioned, the density of bitumen froth is not a controlled variable. However, it was discovered that the solids carrying capacity of froth can be increased by decreasing the temperature and/or the water content of the froth. FIG. 4 shows the concentration (v/v) profile of the sand in a bitumen froth being pumped through a 260 mm diameter pipeline, the froth having 41% total water and 12% sand having an average particle size of 300 μm at a temperature of 45° C. Not surprisingly, even at a velocity of 2.0 m/s, a fairly substantial bed was forming at the bottom of the pipe, i.e., about 20% of the pipeline diameter. However, when both the water content and the temperature of the froth were decreased, i.e., 28% total water, 12% sand at a temperature of 35° C.), little or no bed was formed in the pipeline. This can be seen in FIG. 5. While at a velocity of 0.5 m/s a slight bed was formed (see squares), the bed was not nearly as large or dense as that formed in the previous froth at a velocity of 0.5 m/s.

Unfortunately, however, decreasing the water content and/or temperature of the material over the entire line is not feasible. Further, existing flow rates can be too low to move solids in such a froth. It was discovered, however, that the improved solids transport of froth having decreased water content and/or temperature was due to high pressure gradients being formed.

Figure 6:
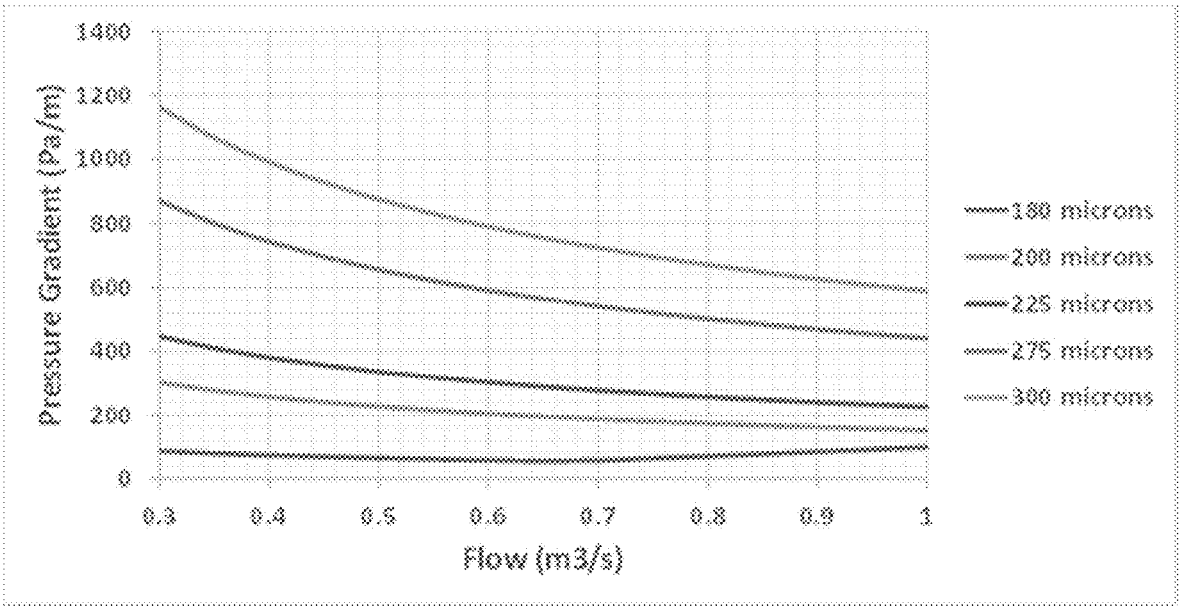
FIG. 6 shows the pressure gradients for various particle sizes with a typical bitumen froth composition.
Figure 7:
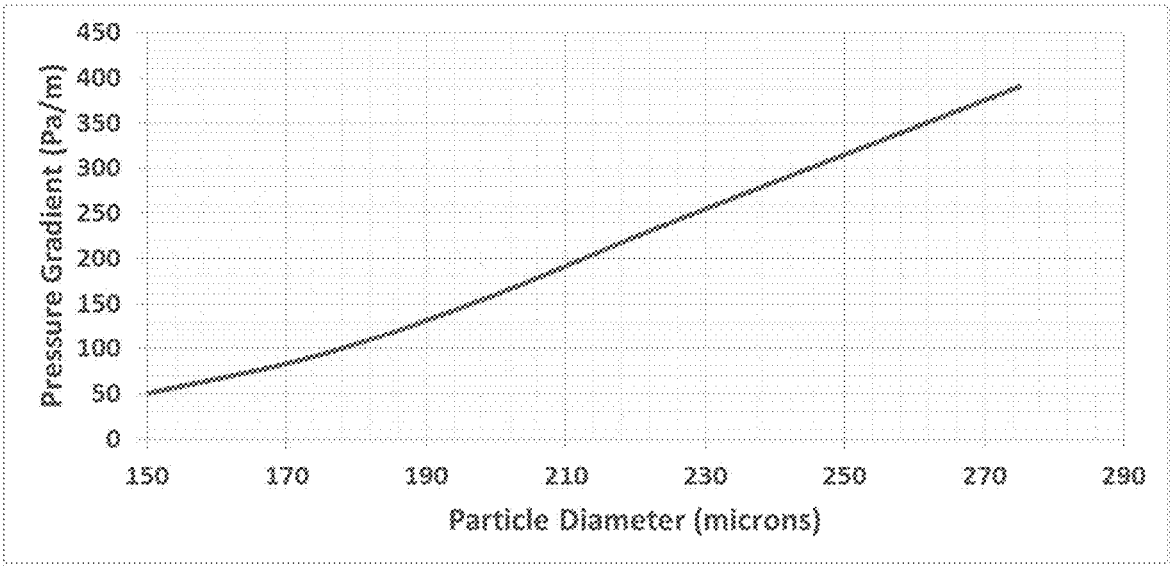
FIG. 7 shows the pressure gradient (Pa/m) required to move a given particle size in a bitumen froth comprising 24% water at 45° C.

As previously discussed, FIG. 3 shows that large beds can begin to form when froths contain particles greater than 180 microns. The pressure gradients associated with these same conditions are shown in FIG. 6. It can be seen from FIG. 6 that the pressure gradient to obtain bed free flow within the range of commercial operation (<120 Pa/m), as discussed above, only occurs for froths having 180 micron particles. However, once a bed forms, high pressure gradients are required to pump through it with a velocity high enough to support the particles. For example, the pressure gradients required to suspend particles of various sizes in a low temperature (45 C), low water content (24%) froth are very high, as shown in FIG. 7. Unfortunately, the required pressure gradients to pump through such a bed are much greater than the installed pumping capacity.

Figure 8A:
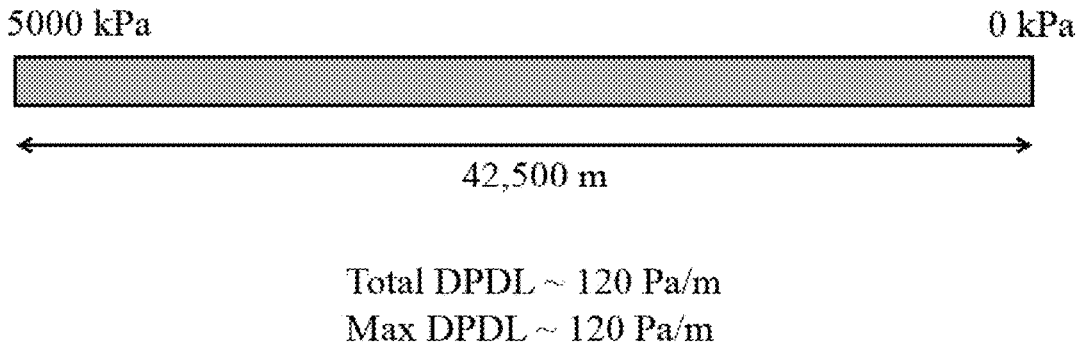
FIG. 8A illustrates a typical 42.5 km pipeline and the average/maximum pressure gradient therein.
Figure 8B:
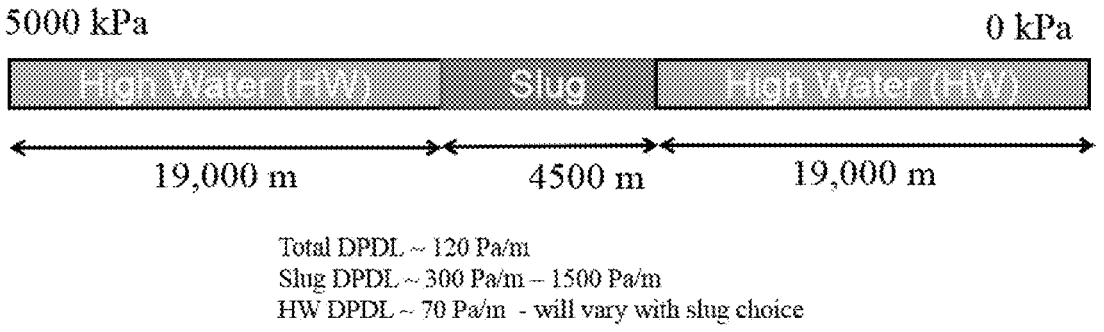
FIG. 8B illustrates the same 42.5 km pipeline wherein a slug of low temperature and/or water content bitumen froth is used to clear solids from the line.

It was discovered by the present applicant that high local pressure gradients can be achieved by using slugs of low water content and/or low temperature froth through a reduced portion of the pipe length. FIG. 8A shows the 42.5 km froth pipeline discussed above where the average and maximum pressure gradient achievable is about 120 Pa/m. FIG. 8B illustrates how the use of a low temperature and/or low water bitumen froth plug (approximately 4.5 km, or approximately 10% of the length of the froth pipeline) can create areas of high pressure gradient. While the total pressure gradient across the pipeline is still approximately 120 Pa/m, the slug pressure gradient can be anywhere from 300 Pa/m to 1500 Pa/m, and must be offset by the lower pressure gradient caused by the high water (HW) content froth upstream and downstream of the slug in the pipeline. Thus, the formation of such a high pressure gradient will be sufficient to either prevent the formation of a coarse solids bed or be able to clear any settled solids bed.

EXAMPLE 1

In this example, bitumen froth having a water content of 22 wt % and a high coarse solids content is diluted with water to achieve a diluted bitumen froth having a water content of 30 wt % prior to pumping the froth through a froth pipeline. However, because the bitumen froth has a high amount of coarse solids, a bed of solids may start to form on the bottom of the froth pipeline. When this happened, the amount of water added to the bitumen froth is reduced to achieve a bitumen froth slug having a water content of 26 wt. %. The lower water content bitumen froth slug is then pumped through the pipeline for about fifteen (15) minutes. This is referred to as a short pulse slug of bitumen froth, as shown in FIG. 9C, which is sufficient to reduce the bed of solids forming at the bottom of the froth pipeline. Once the fifteen minutes has passed, the bitumen froth is once again diluted with dilution water to achieve a froth with 30 wt. % water once again. Generally, the short pulse slug is repeated every 6 to 8 hours.

In one embodiment, the duration of the short pulse slug is between fifteen (15) to thirty (30) minutes and there can be one or two slugs in the pipeline at a time. The slugs generally have between about 5-7 wt. % less water than the diluted bitumen froth being pumped through the pipeline.

EXAMPLE 2

Figure 9A:
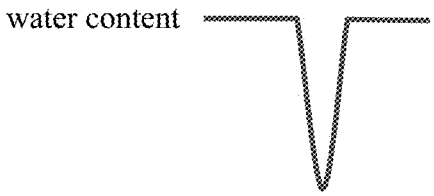
FIGS. 9A, 9B, 9C, 9D and 9E show the geometries of various bitumen froth slugs having reduced water content useful in the present invention. In particular, 9A shows a scour wave slug; 9B shows a wave slug, 9C shows a short pulse slug; 9D shows an oscillation slug; and 9E shows a long pulse slug.

In this example, a scour wave slug of bitumen froth is used to clear and/or prevent the accumulation of coarse solids in a froth pipeline (see FIG. 9A). Initially, diluted bitumen froth having 30 wt. % water is pumped through the froth pipeline at a flow rate of between about 550 and 850 L/s. The water content of the bitumen froth is then dropped down to 26 wt. % water for a period of about one hour (scour wave slug of bitumen froth). After an hour, the bitumen froth is again diluted to about 30 wt. % water. In one embodiment, there can be two slugs in the froth pipeline at a time. In one embodiment, the water content of the scour wave bitumen froth slug is reduced by 4-7 wt. %.

EXAMPLE 3

Figure 9B:
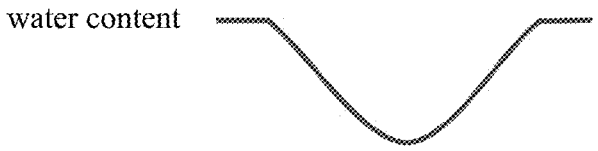
Figure 9C:
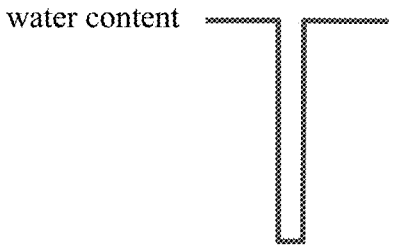

In this example, a wave slug of bitumen froth is used for a duration of 6-12 hours. In one embodiment, up to four consecutive waves are used at a time. In particular, a bitumen froth wave having a reduced water content of 5-7 wt. % is pumped through the froth pipeline, as shown in FIG. 9B. This example is designed to hold a specific average water content in the froth pipeline.

EXAMPLE 4

Figure 9D:
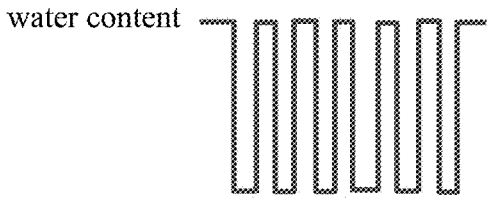

In this example, an oscillation bitumen froth slug is used. This embodiment is particularly useful when the bitumen froth flow rate is at the upper end of the operating envelope. Bitumen froth slugs having a reduced water content of 5-9 wt. % are released in 30-60 minute cycles and continued for up to several days (see FIG. 9D).

EXAMPLE 5

Figure 9E:
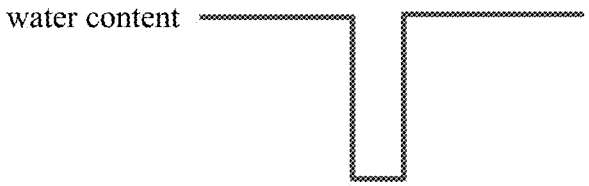

In this example, a long pulse bitumen froth slug is used (see FIG. 9E). The bitumen froth slug has a reduced water content of 5-7 wt. % and is delivered through the froth pipeline for a period of 1-2 hours. There can be up to two long pulse slugs in the froth line at a time.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method for transporting a bitumen froth having a first water content, a first temperature and coarse solids having a particle size>180 μm through a pipeline, the method comprising the steps of: injecting the bitumen froth into the pipeline; and injecting into the pipeline a bitumen froth slug having a second water content and a second temperature to prevent the formation of or to remove a stationary or sliding bed of coarse solids; whereby either the second water content, the second temperature or both of the bitumen froth slug is lower than the first water content, the first temperature or both of the bitumen froth.

Clause 2, the method of clause 1, wherein the second water content is between about 2 wt. % and about 10 wt. % lower than the first water content.

Clause 3, the method of clause 1, wherein the second temperature is between about 2° C. and about 10° C. lower than the first temperature.

Clause 4, the method of clause 1, wherein the bitumen froth slug comprises between about 3 percent and about 100 percent of the length of the pipeline.

Clause 5, the method of clause 1, wherein the bitumen froth has coarse solids having a particle size>300 μm.

Clause 6, the method of clause 1, wherein the bitumen froth slug is injected into the pipeline for a period of between about 15 minutes and about 30 minutes.

Clause 7, the method of clause 1, wherein the bitumen froth slug is injected into the pipeline for a period of between about one hour and about two hours.

Clause 8, the method of clause 1, wherein the bitumen froth slug is injected into the pipeline for a period of between about 6 hours and about 12 hours.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, 10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range.

Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A method for transporting a bitumen froth having a first water content, a first temperature and coarse solids having a particle size>180 μm through a pipeline, the method comprising the steps of:

injecting the bitumen froth into the pipeline; and injecting into the pipeline a bitumen froth slug having a second water content and a second temperature to prevent the formation of or to remove stationary or provide a sliding bed of coarse solids;

whereby either the second water content, the second temperature or both of the bitumen froth slug is lower than the first water content, the first temperature or both of the bitumen froth.

2. The method of claim 1, wherein the second water content is between about 2 wt. % and about 10 wt. % lower than the first water content.

3. The method of claim 1, wherein the second temperature is between about 2° C. and about 10° C. lower than the first temperature.

4. The method of claim 1, wherein the bitumen froth slug comprises between about 3 percent and about 100 percent of the length of the pipeline.

5. The method of claim 1, wherein the bitumen froth has coarse solids having a particle size>300 μm.

6. The method of claim 1, wherein the bitumen froth slug is injected into the pipeline for a period of between about 15 minutes and about 30 minutes.

7. The method of claim 1, wherein the bitumen froth slug is injected into the pipeline for a period of between about one hour and about two hours.

8. The method of claim 1, wherein the bitumen froth slug is injected into the pipeline for a period of between about 6 hours and about 12 hours.

* * * * *